US011440316B2

(12) United States Patent
Sato et al.

(10) Patent No.: US 11,440,316 B2
(45) Date of Patent: Sep. 13, 2022

(54) RECORDING APPARATUS AND DETERMINATION METHOD

(71) Applicant: CANON KABUSHIKI KAISHA, Tokyo (JP)

(72) Inventors: Kohei Sato, Kanagawa (JP); Yuhei Oikawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 46 days.

(21) Appl. No.: 17/160,108

(22) Filed: Jan. 27, 2021

(65) Prior Publication Data

US 2021/0237437 A1 Aug. 5, 2021

(30) Foreign Application Priority Data

Jan. 31, 2020 (JP) ..... JP2020-015181

(51) Int. Cl.
*B41J 2/045* (2006.01)

(52) U.S. Cl.
CPC ..... *B41J 2/04563* (2013.01); *B41J 2/0458* (2013.01); *B41J 2/04541* (2013.01); *B41J 2/04573* (2013.01); *B41J 2/04588* (2013.01)

(58) Field of Classification Search
CPC ... B41J 2/04563; B41J 2/04588; B41J 2/2142
See application file for complete search history.

(56) References Cited

U.S. PATENT DOCUMENTS

| | | | | |
|---|---|---|---|---|
| 9,327,512 | B2 * | 5/2016 | Van Brocklin | B41J 2/04581 |
| 2006/0268046 | A1 * | 11/2006 | Ootsuka | B41J 2/04581 347/20 |
| 2006/0284914 | A1 * | 12/2006 | Murakami | B41J 2/175 347/17 |
| 2007/0280722 | A1 * | 12/2007 | Katada | B41J 2/175 430/114 |
| 2007/0291067 | A1 | 12/2007 | Aoki et al. | |

* cited by examiner

*Primary Examiner* — Lam S Nguyen
(74) *Attorney, Agent, or Firm* — Canon U.S.A., Inc. IP Division

(57) ABSTRACT

A recording apparatus includes a recording head including a plurality of ejection ports and a recording element, a driving unit configured to apply a driving pulse to drive the recording element, a temperature detection unit configured to detect a temperature change in a vicinity of the recording element, a determination unit configured to determine an ink ejection state of each of the ejection ports on the basis of the temperature change detected by the temperature detection unit, an acquisition unit configured to acquire information about atmospheric pressure around the recording head, and a setting unit configured to, when the determination unit determines the ink ejection state, set the driving pulse to be applied by the driving unit to the recording element on the basis of the information about the atmospheric pressure acquired by the acquisition unit.

13 Claims, 16 Drawing Sheets

1 atm 0.7 atm 1 atm 0.7 atm

FIG.11

| | FIRST DRIVING PULSE | |
|---|---|---|
| ATMOSPHERIC PRESSURE [atm] | PT0 [μsec] | PT1 [μsec] |
| 1.00 | 0.00 | 0.60 |
| 0.90 | 0.00 | 0.64 |
| 0.80 | 0.00 | 0.68 |
| 0.70 | 0.00 | 0.72 |

FIG.14

| | FIRST DRIVING PULSE | | SECOND DRIVING PULSE | |
|---|---|---|---|---|
| ATMOSPHERIC PRESSURE [atm] | PT0 [μsec] | PT1 [μsec] | PT2 [μsec] | PT3 [μsec] |
| 1.00 | 0.00 | 0.60 | 3.00 | 3.30 |
| 0.90 | 0.00 | 0.60 | 2.93 | 3.30 |
| 0.80 | 0.00 | 0.60 | 2.87 | 3.30 |
| 0.70 | 0.00 | 0.60 | 2.80 | 3.30 |

FIG.16

| | FIRST DRIVING PULSE | | SECOND DRIVING PULSE | |
|---|---|---|---|---|
| ATMOSPHERIC PRESSURE [atm] | PT0 [μsec] | PT1 [μsec] | PT2 [μsec] | PT3 [μsec] |
| 1.00 | 0.00 | 0.60 | 3.00 | 3.30 |
| 0.90 | 0.00 | 0.60 | 3.50 | 3.80 |
| 0.80 | 0.00 | 0.60 | 4.00 | 4.30 |
| 0.70 | 0.00 | 0.60 | 4.50 | 4.80 |

RECORDING APPARATUS AND DETERMINATION METHOD

BACKGROUND

Field of the Disclosure

The present disclosure relates to a recording apparatus and a control method of the recording apparatus.

Description of the Related Art

United States Patent Application Publication No. 2007/0291067 discusses a method of detecting a temperature change in the vicinity of a heater that generates heat energy to detect defective ejection of ink from a recording head. Specifically, in the case of normal ejection, a point at which a temperature falling rate changes appears after the elapse of a predetermined time period from a time at which a detected temperature reaches a maximum, but this point does not appear in the case of defective ejection. The discussed technique utilizes this feature and determines an ink ejection state by detecting presence or absence of this point.

SUMMARY

According to an aspect of the present disclosure, a recording apparatus includes a recording head including a plurality of ejection ports and a recording element provided at a position corresponding to each of the ejection ports and configured to generate heat energy, the recording head being configured to eject ink from the ejection ports by driving of the recording element, a driving unit configured to apply a driving pulse to drive the recording element, a temperature detection unit configured to detect a temperature change in a vicinity of the recording element when the recording element is driven by application of the driving pulse to eject ink, a determination unit configured to determine an ink ejection state of each of the ejection ports on the basis of the temperature change detected by the temperature detection unit, an acquisition unit configured to acquire information about atmospheric pressure around the recording head, and a setting unit configured to, when the determination unit determines the ink ejection state, set the driving pulse to be applied by the driving unit to the recording element on the basis of the information about the atmospheric pressure acquired by the acquisition unit.

Further features of the present disclosure will become apparent from the following description of exemplary embodiments with reference to the attached drawings.

BRIEF DESCRIPTION OF THE DRAWINGS

FIG. 11 illustrates a table to set a driving pulse according to one or more aspects of the present disclosure.

FIG. 14 illustrates a table to set a driving pulse according to one or more aspects of the present disclosure.

FIG. 16 illustrates a table to set a driving pulse according to one or more aspects of the present disclosure.

DESCRIPTION OF THE EMBODIMENTS

Ink, which is liquid, is susceptible to atmospheric pressure, and changes in behavior at the time of being ejected from a recording head depending on the atmospheric pressure surrounding the recording apparatus. For example, in a case where an ink ejection state is to be determined using the technique of United States Patent Application Publication No. 2007/0291067, depending on the atmospheric pressure, a period of time from a time at which a temperature detected in the vicinity of a recording element, which generates heat energy, reaches a maximum to a point at which a change in a temperature falling rate appears changes, and an amount of change in the temperature falling rate changes. Thus, there is a possibility that the ejection state cannot be determined correctly depending on the surrounding atmospheric pressure.

The present disclosure is directed to determining the ink ejection state regardless of a change in the surrounding atmospheric pressure.

Exemplary embodiments will be described below with reference to the accompanying drawings.

Herein, "recording" (also referred to as "print") is not limited to forming meaningful information such as characters and figures. It does not matter if the information is meaningful or meaningless. In addition, the recording also represents forming of an image, a design, a pattern, or the like on a recording medium or performing processing on a medium in a broad sense, and it does not matter if the information is apparent information that is visually perceivable by a human.

The "recording medium" represents not only paper, which is used in a typical recording apparatus, but also a material that can accept ink in a broad sense, such as cloth, a film of plastic, a metal plate, glass, ceramics, wood, and leather.

Furthermore, "ink" (also referred to as "liquid") is to be broadly interpreted, similarly to the definition of "recording (print)" described above. Thus, the ink represents a liquid that can be supplied in formation of an image, a design, a pattern, or the like, processing on the recording medium, or processing of ink (e.g., coagulation or insolubilization of a coloring material in ink supplied on the recording medium) by being added on the recording medium.

An element substrate for the recording head (head substrate) used hereinafter represents not a mere base member made of a silicon semiconductor, but a configuration including elements, wiring, and the like arranged thereon.

Furthermore, "on the substrate" represents not only simply being on the element substrate, but also represents being on a surface of the element substrate and being inside the element substrate near the surface.

<Configuration of Recording Apparatus>

Figure 1:
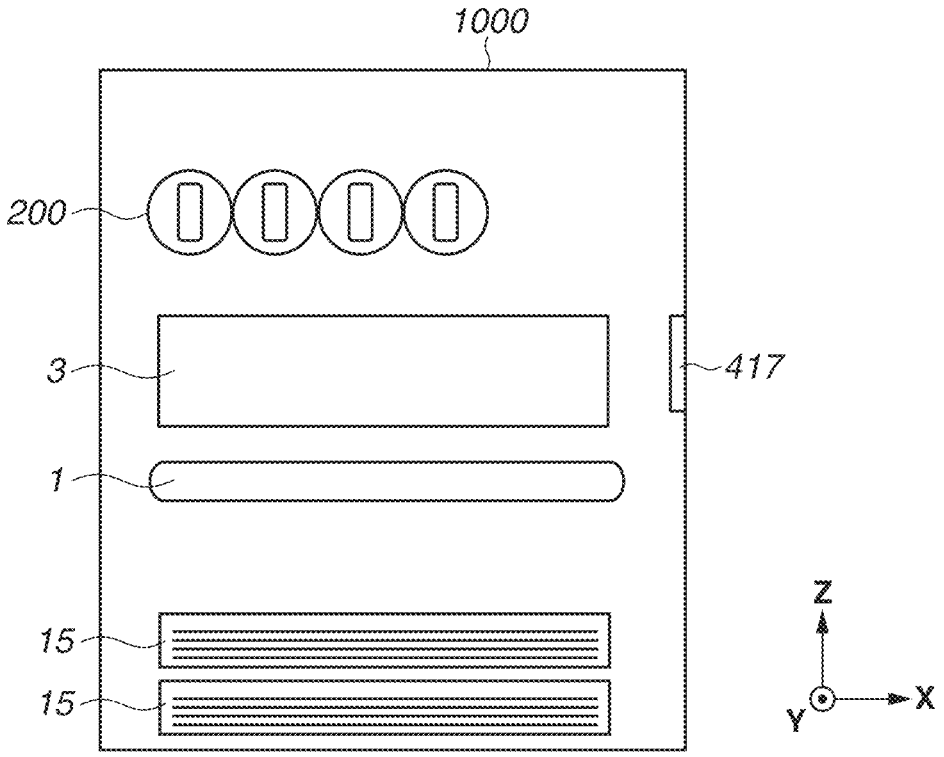
FIG. 1 is a schematic internal view illustrating a recording apparatus according to one or more aspects of the present disclosure.

FIG. 1 is a schematic internal view illustrating a recording apparatus 1000 according to an exemplary embodiment.

Figure 2:
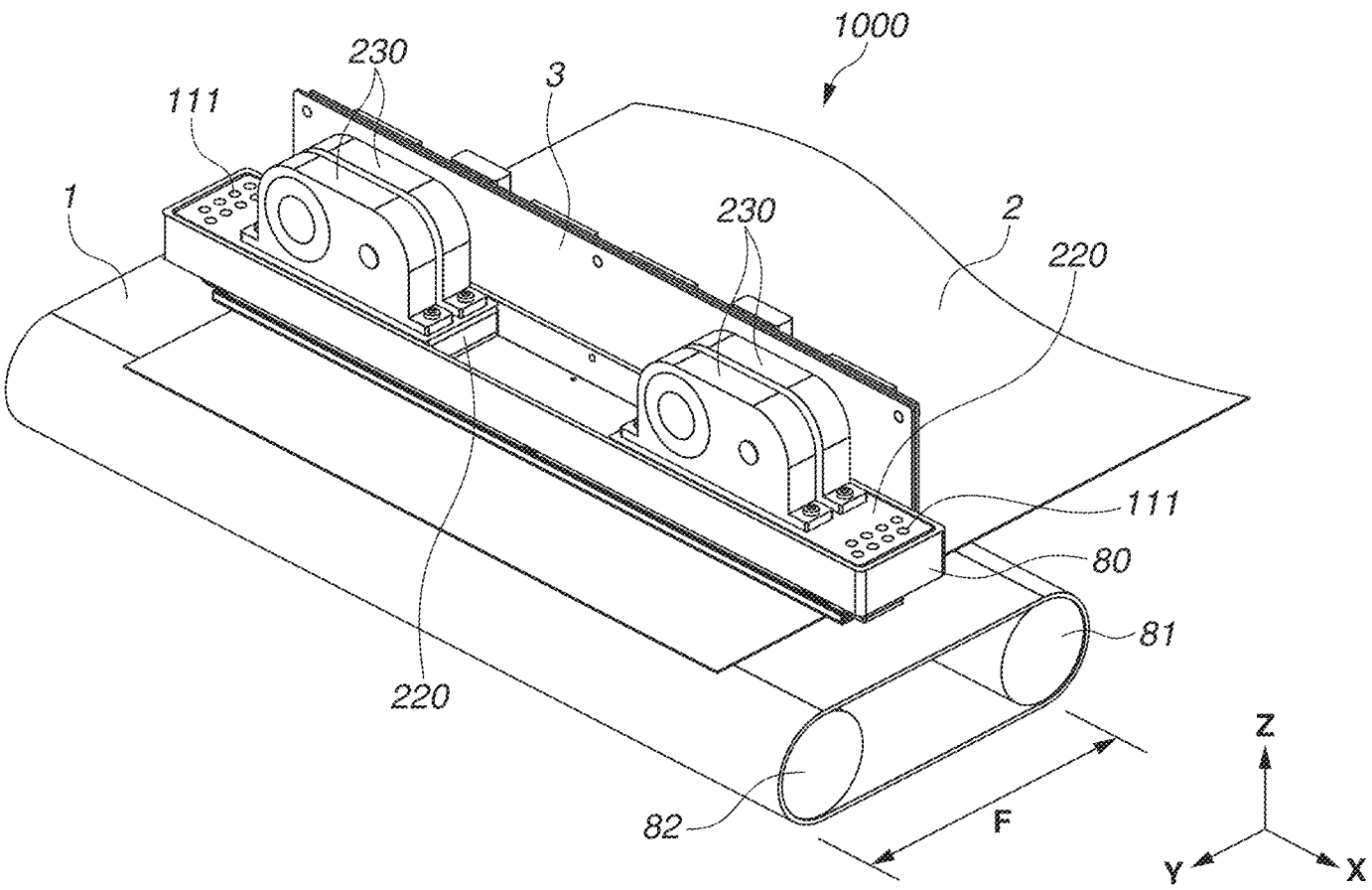
FIG. 2 is a perspective view schematically illustrating an internal structure of the recording apparatus according to one or more aspects of the present disclosure.

FIG. 2 is a perspective view schematically illustrating an internal configuration of the recording apparatus 1000 according to the present exemplary embodiment. As illustrated in FIG. 1, the recording apparatus 1000 includes a stacking unit 15 on which a recording medium 2 is stacked, a conveyance unit 1 that conveys the recording medium 2 in a Y-direction, a recording head 3, an ink tank 200, and a print engine unit 417. As illustrated in FIG. 2, the conveyance unit 1 includes two conveyance rollers 81 and 82 arranged being separated from each other at a distance F in the Y-direction. Rotation of the conveyance rollers 81 and 82 conveys the recording medium 2. The recording head 3 is a so-called full-line recording head that has an ejection port array in which ejection ports are arrayed across a width of the recording medium 2. The ejection opening ejects ink in an X-direction intersecting the Y-direction that is a conveyance direction of the recording medium 2. The recording head 3 is capable of ejecting ink of a plurality of colors, and ejection port arrays ejecting ink in respective colors are arranged in the Y-direction. In the present exemplary embodiment, the recording head 3 is capable of ejecting ink in cyan (C), magenta (M), yellow (Y), and black (K). The recording apparatus 1000 records an image by causing the conveyance unit 1 to convey the recording medium 2 and the recording head 3 to eject ink on the recording medium 2. The recording medium 2 may be a cut sheet or a continuous roll sheet.

A housing 80 of the recording head 3 includes a negative pressure control unit 230, a liquid supply unit 220, and a liquid connection unit 111. Ink is supplied to the liquid supply unit 220 via the liquid connection unit 111 that supplies or ejects ink from an ink tank 200 (refer to FIG. 1) to the liquid supply unit 220. The liquid supply unit 220 supplies ink to each ejection port of the recording head 3. The negative pressure control unit 230 controls a negative pressure in a path for supplying ink. In addition, an electric control unit (not illustrated) that transmits power and an ejection control signal to the recording head 3 is electrically connected to the recording head 3.

An electrothermal transducing element (hereinafter also referred to as a heater) as a recording element 309 to eject ink (refer to FIGS. 4A to 4C) is provided on a substrate of the recording head 3 according to the present exemplary embodiment. The electrothermal transducing element is provided for each of the ejection ports. In response to a recording signal, a print controller 419 (refer to FIG. 3) applies a pulse voltage to the electrothermal transducing element corresponding to the recording signal, whereby the electrothermal transducing element generates heat energy to heat ink, and ink is ejected from the ejection port. A voltage applied to the electrothermal transducing element is 24 V in the present exemplary embodiment.

In addition, the recording apparatus 1000 is provided with a recovery unit (not illustrated) to recover the ejection state of the recording head 3. The recovery unit includes a wiping member that wipes an ejection port surface of the recording head 3 and a suction unit that suctions ink on the ejection port surface. Operating the recovery unit can remove ink attached to the ejection port surface and recover the ink ejection state, Examples of a method of recovering the ink ejection state include preliminary ejection that ejects ink outside the recording medium irrespectively of recording of an image. The recovery operation can be performed before a start of recording or after the recording. The recording apparatus is not limited to the recording apparatus using the above-described full-line recording head having a recording width corresponding to the width of the recording medium. For example, the present embodiment can be applied to a so-called serial-type recording apparatus provided with a recording head in which the ejection ports are arrayed in the conveyance direction of the recording medium in a carriage and configured to perform recording by ejecting ink to the recording medium while reciprocally scanning with the carriage.

<Description of Control Configuration>

Figure 3:
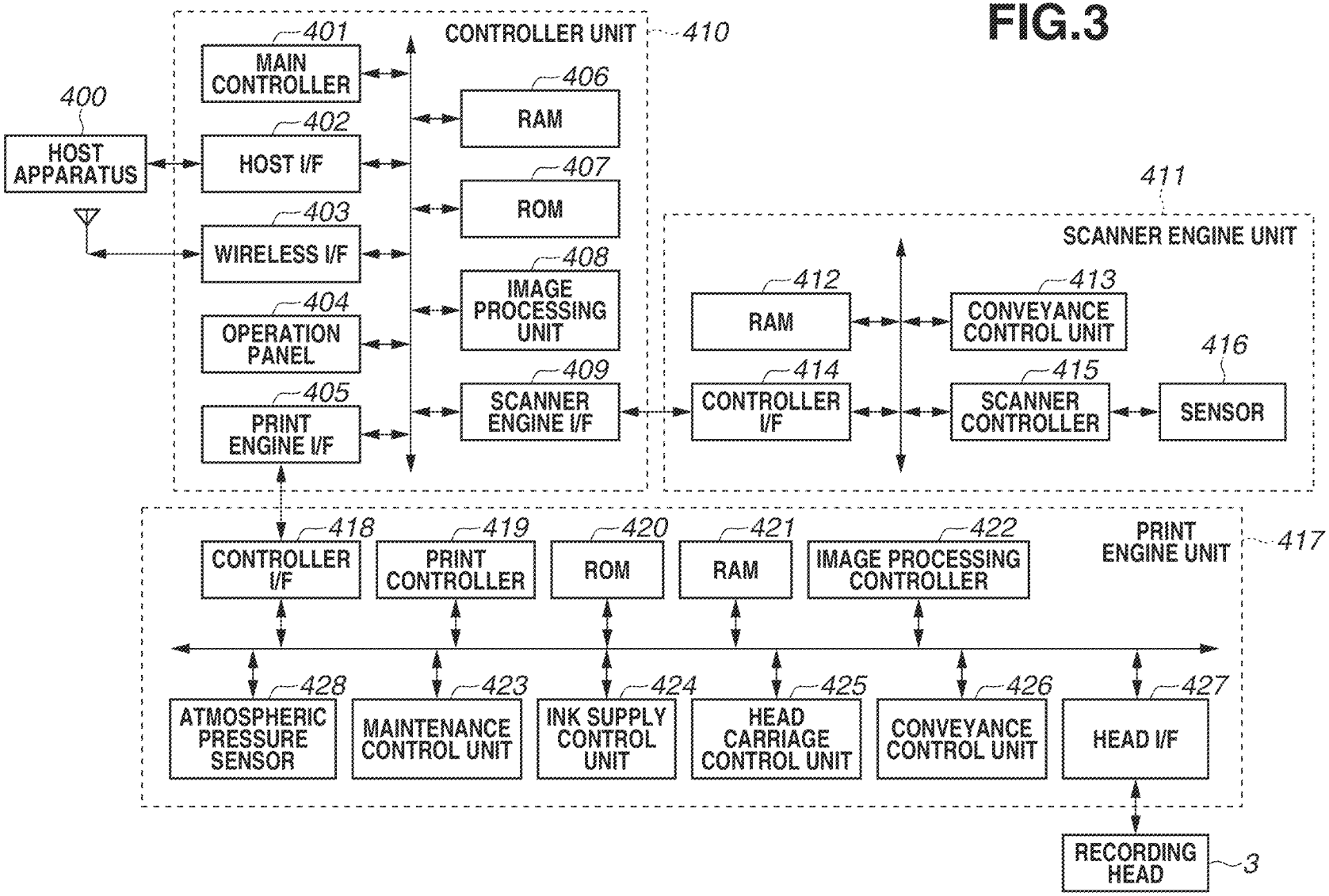
FIG. 3 is a block diagram illustrating a configuration of a control circuit of the recording apparatus according to one or more aspects of the present disclosure.

FIG. 3 is a block diagram illustrating a configuration of a control circuit of the recording apparatus 1000.

As illustrated in FIG. 3, the recording apparatus 1000 includes a print engine unit 417, a scanner engine unit 411, and a controller unit 410. The print engine unit 417 mainly controls a recording unit. The scanner engine unit 411 controls a scanner unit. The controller unit 410 controls the whole of the recording apparatus 1000. The print controller 419 that includes a nonvolatile memory, such as a microprocessing unit (MPU) and an electrically erasable programmable read-only memory (EEPROM), controls various kinds of mechanisms of the print engine unit 417 in accordance with instructions from a main controller 401 of the controller unit 410. Various kinds of mechanisms of the scanner engine unit 411 are controlled by the main controller 401 of the controller unit 410.

In the controller unit 410, the main controller 401 including a central processing unit (CPU) controls the whole of the recording apparatus 1000 using a random-access memory (RAM) 406 as a work area on the basis of a program and various parameters stored in a read-only memory (ROM) 407. For example, if a print job is input from a host apparatus 400 via a host interface (I/F) 402 or a wireless IX 403, an image processing unit 408, performs predetermined image processing on received image data in accordance with an instruction from the main controller 401. Then, the main controller 401 transmits the image data subjected to the image processing to the print engine unit 417 via a print engine I/F 405.

The recording apparatus 1000 may acquire image data from the host apparatus 400 using wireless communication or wired communication, or may acquire image data from an external storage apparatus (e.g., a universal serial bus (USB)) connected to the recording apparatus 1000. A communication method used in the wireless communication or the wired communication is not limited. For example, Wireless Fidelity® (Wi-Fi®) and Bluetooth® can be employed as a communication method used in the wireless communication. In addition, the USB can be employed as a communication method used in the wired communication. Furthermore, for example, if a command for reading is input from the host apparatus 400, the main controller 401 transmits the command to the scanner engine unit 411 via a scanner engine 409.

An operation panel 404 is a unit on which a user performs input to and output from the recording apparatus 1000. The user can instruct operations such as copy and scan, set a recording mode, and recognize information about the recording apparatus 1000 via the operation panel 404.

In the print engine unit 417, the print controller 419 that includes a CPU controls various kinds of mechanisms included in the print engine unit 417 using a RAM 421 as a work area on the basis of a program and various kinds of parameters stored in a ROM 420.

If a command or image data is received via a controller I/F 418, the print controller 419 temporarily stores the command or the image data in the RAM 421. The print controller 419 causes an image processing controller 422 to convert the image data stored in the RAM 421 into recording data so that the recording head 3 can use the data in a recording operation. When the recording data is generated, the print controller 419 as a driving unit applies a driving pulse to the recording head 3 on the basis of the recording data via a head IX 427, and causes the recording head 3 to eject ink. At this time, the print controller 419 drives the conveyance rollers 81 and 82 by operating a motor, which is not illustrated, via a conveyance control unit 426, and conveys the recording medium 2, ink is ejected from the recording head 3 in coordination with a conveyance operation of the recording medium 2, and recording is performed.

An atmospheric pressure sensor 428 is installed on a substrate of the print engine unit 417 of the recording apparatus 1000, and is capable of measuring atmospheric pressure in an installation environment. Since there is no significant difference between the atmospheric pressure surrounding the recording head 3 and the atmospheric pressure in the installation environment, information about the atmospheric pressure acquired by the atmospheric pressure sensor 428 can be used as information about the atmospheric pressure surrounding the recording head 3. For example, a piezoresistive pressure sensor can be used as the atmospheric pressure sensor 428. The piezoresistive pressure sensor uses a silicon single crystal substrate as a diaphragm (pressure receiving element), and a resistance bridge circuit is formed by spreading impurities on the surface of the silicon single crystal substrate. Applying pressure to the diaphragm deforms the diaphragm and changes a resistance value of a resistance bridge. Outputting an electric signal using the resistance bridge as an electrothermal transducing element enables measurement of the pressure. Alternatively, an electrostatic capacitance sensor that detects displacement of the diaphragm may be used as the atmospheric pressure sensor 428.

The recording apparatus 1000 may not necessarily use the atmospheric pressure sensor 428 if the recording apparatus 1000 can infer the atmospheric pressure in the installation environment. Alternatively, the recording apparatus 1000 can infer the atmospheric pressure in the installation environment by acquiring, for example, information about a height above sea level, a latitude and longitude, or the name of a region. The information such as the latitude and longitude can be acquired by using a device such as a graphics processing unit (GPU) or by a method of directly inputting the information by the user to the operation panel 404.

With regard to the scanner engine unit 411, the main controller 401 of the controller unit 410 controls hardware resources of a scanner controller 415 using the RAM 406 as a work area on the basis of a program and various parameters stored in the ROM 407. Accordingly, various kinds of mechanisms included in the scanner engine unit 411 are controlled. For example, the main controller 401 controls the hardware resources in the scanner controller 415 via a controller I/F 414, conveys, via a conveyance control unit 413, a document loaded on an automatic document feeder (ADF) (not illustrated) by the user, and scans the document with a sensor 416. Then, the scanner controller 415 temporarily stores read image data in a RAM 412.

The print controller 419 is capable of causing the recording head 3 to execute a recording operation on the basis of the image data scanned by the scanner controller 415 by converting the image data acquired by the scanner engine unit 411 into recording data.

<Description of Configuration of Temperature Detection Element>

Figure 4A:
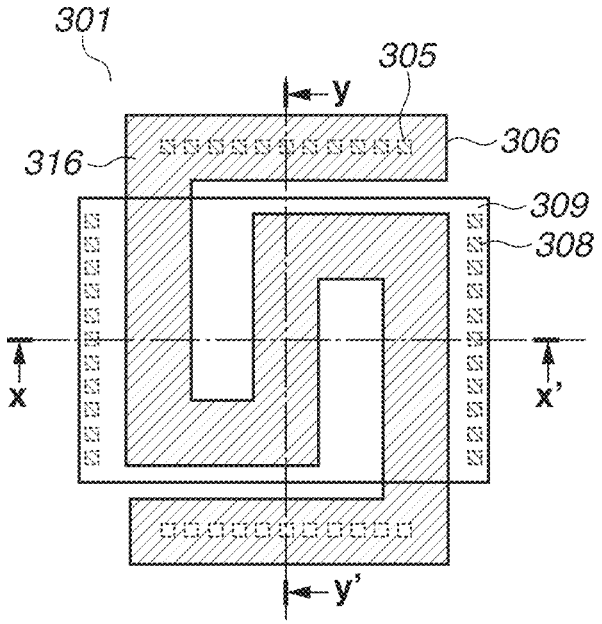
FIGS. 4A to 4C are diagrams each illustrating a multi-layered wiring structure in the vicinity of a recording element formed on a silicon substrate according to one or more aspects of the present disclosure.
Figure 4C:
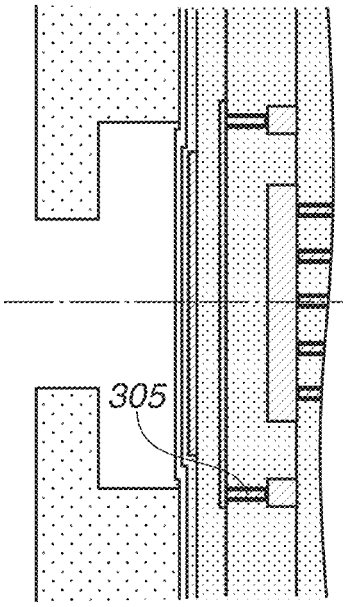
Figure 4B:
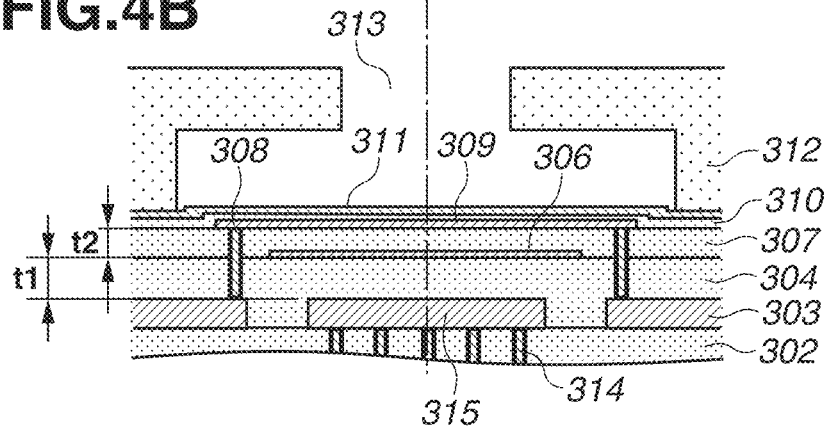

FIGS. 4A to 4C are diagrams each illustrating a multi-layered wiring structure in the vicinity of the recording element 309 formed on a silicon substrate 301.

FIG. 4A is a top view illustrating a temperature detection element 306 having a sheet-like form disposed below the recording element 309 via an interlayer insulating film 307. FIG. 4B is a cross-sectional view illustrating a cross section obtained by cutting the silicon substrate 301 vertically along a broken line x-x' in the top view of FIG. 4A. FIG. 4C is a cross-sectional view illustrating a cross section obtained by cutting the silicon substrate 301 vertically along a broken line y-y' in FIG. 4A.

In the x-x' cross-sectional view illustrated in FIG. 4B and the y-y' cross-sectional view illustrated in FIG. 4C, wiring 303 made of aluminum or the like is formed on an insulating film 302 stacked on the silicon substrate 301, and furthermore, an interlayer insulating film 304 is formed on the wiring 303. The interlayer insulating film 304 functions as a heat storage layer having a thickness t1. The wiring 303 and the temperature detection element 306 are electrically connected with each other through a conductive plug 305 (refer to FIG. 4C). The temperature detection element 306 is a thin film resistor including titanium and titanium nitride films. The conductive plug 305 is embedded in the interlayer insulating film 304 and made of tungsten or the like.

A metal layer 315 is disposed immediately below the recording element 309. In addition, a plug 314 for heat dissipation configured to conduct heat is displaced in contact with the surface of the metal layer 315. The metal layer 315 and the plug 314 constitute a heat dissipation path from the recording element 309. The metal layer 315 for heat dissipation is disposed at a position overlapping at least part of the recording element 309 and part of the temperature detection element 306 when viewed from a direction of stacking layers, and has a shape similar to that of the recording element 309.

The interlayer insulating film 307 is formed on the upside of the temperature detection element 306 in FIG. 4B. The interlayer insulating film 307 is disposed immediately below the recording element 309 and functions as a heat storage layer having a thickness t2. The wiring 303 and the recording element 309 are electrically connected with each other via a conductive plug 308. The recording element 309 is a heating generation resistor made of a tantalum-silicon-nitride film or the like. The conductive plug 308, which is made of tungsten or the like, penetrates through the interlayer insulating film 304 and the interlayer insulating film 307. In the present exemplary embodiment, the conductive plug that penetrates the interlayer insulating film 304 and the interlayer insulating film 307 is employed to connect a lower-layer conductive plug and an upper-layer conductive plug.

Furthermore, in the present exemplary embodiment, in order to secure reliability of conductivity depending on a depth of a plug, the conductive plug 305 that penetrates through one interlayer insulating film has a diameter of 0.4 μm, and the conductive plug 308 that penetrates through two interlayer insulating films has a larger diameter of 0.6 μm.

In FIG. 4B, a protective film 310 such as a silicon nitride film is formed on the upper side of the conductive plug 308, and a cavitation resistance film 311 made of tantalum or the like is formed on the protective film 310. Furthermore, an ejection port 313 is formed by a nozzle formation material 312 made of photosensitive resin or the like.

In this manner, the silicon substrate 301 according to the present exemplary embodiment has a multi-layered wiring structure in which the temperature detection element 306 as an independent intermediate layer is provided between a layer of the wiring 303 and a layer of the recording element 309.

The silicon substrate 301 is configured to include a plurality of recording elements 309 having the configuration described above. Using such an element substrate enables acquisition of temperature information from each of the temperature detection elements 306 arranged corresponding to the respective recording elements 309.

Then, this configuration enables acquisition of a determination result signal RSLT indicating the ink ejection state of the corresponding recording element 309 by a logic circuit (inspection unit) provided inside the element substrate from the temperature information and temperature change detected by the temperature detection element 306. The determination result signal RSLT is a one-bit signal, and a value of "1" indicates normal ejection and a value of "0" indicates defective ejection in the present exemplary embodiment.

<Description of Temperature Detection Configuration>

Figure 5:
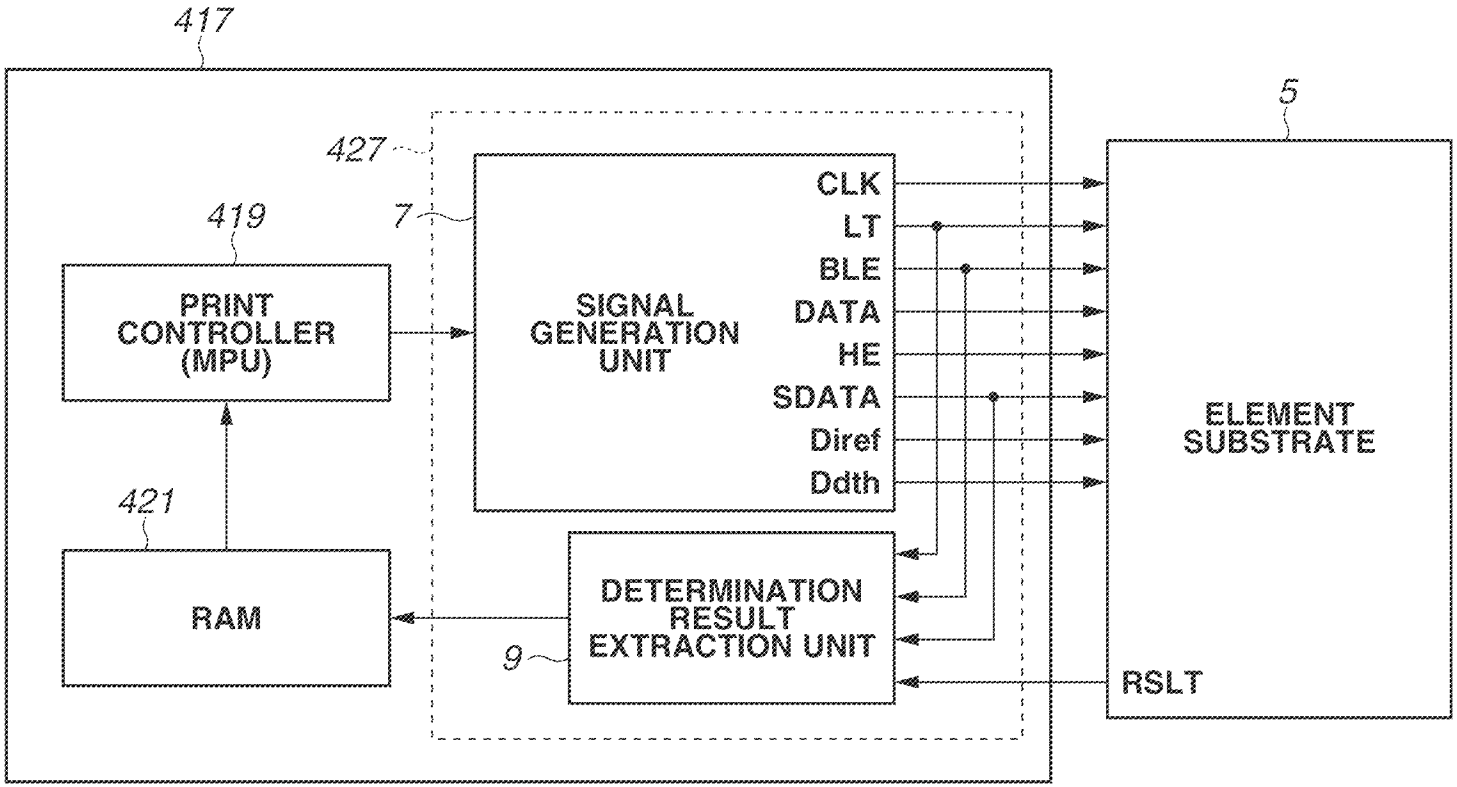
FIG. 5 is a block diagram illustrating a configuration to control temperature detection using an element substrate according to one or more aspects of the present disclosure.

FIG. 5 is a block diagram illustrating a configuration to control temperature detection using the element substrate illustrated in FIGS. 4A to 4C.

As illustrated in FIG. 5, the print engine unit 417 includes the print controller 419, the head I/F 427, and the RAM 421. The print controller 419 includes the MPU to detect a temperature of the recording element 309 provided on an element substrate 5. The head I/F 427 is connected with the recording head 3. In addition, the head I/F 427 includes a signal generation unit 7 and a determination result extraction unit 9. The signal generation unit 7 generates various kinds of signals to be transmitted to the element substrate 5 functioning as a temperature detection unit. The determination result signal RSLT output from the element substrate 5 on the basis of the temperature information detected by the temperature detection element 306 is input to the determination result extraction unit 9.

The print controller 419 issues an instruction to the signal generation unit 7 to detect a temperature. The signal generation unit 7 generates a clock signal CLK, a latch signal LT, a block signal BLE, a recording data signal DATA, a heat enable signal FIE, a sensor selection signal SDATA, a constant current signal Diref, and an ejection inspection threshold signal Ddth, and input the signals to the element substrate 5. Among these signals, the latch signal LT, the block signal BLE, and the sensor selection signal SDATA are also input to the determination result extraction unit 9 of the print engine unit 417.

The sensor selection signal SDATA includes selection information to select a temperature detection element 306 that detects temperature information, information designating an amount of energization to the selected temperature detection element 306, and information regarding an instruction to output the determination result signal RSLT. For example, a case is cited where the element substrate 5 is configured to include five recording element arrays each including a plurality of recording elements 309. In this case, the selection information included in the sensor selection signal SDATA includes array selection information to designate a recording element array, and recording element selection information to designate a recording element 309 of the selected recording element array.

When the signals are input to the element substrate 5 from the signal generation unit 7, the element substrate 5 functioning as a determination unit outputs a one-bit determination result signal RSLT on the basis of the temperature information detected by the temperature detection element 306 corresponding to the one recording element 309 designated by the sensor selection signal SDATA. The output determination result signal RSLT is input to the determination result extraction unit 9.

The determination result signal RSLT is obtained by comparing the temperature information output from the temperature detection element 306 and an ejection inspection threshold voltage TH indicated by the ejection inspection threshold signal Ddth in the element substrate 5. This comparison will be described below in detail.

In the present exemplary embodiment, a configuration is employed in which the one-bit determination result signal RSLT is output per five recording element arrays. Thus, in a configuration in which the element substrate 5 includes ten recording element arrays, the determination result signal RSLT has two bits, and the two-bit signal is output to the determination result extraction unit 9 serially via one signal line.

The determination result extraction unit 9 receives the determination result signal RSLT output from the element substrate 5 on the basis of the temperature information detected by the temperature detection element 306, and extracts a determination result in each latch time period in synchronization with the fall of the latch signal LT. Then, the determination result is stored in the RAM 421 in association with the inspected recording element 309. Alternatively, in a case where the determination result indicates defective ejection, the block signal BLE and the sensor selection signal SDATA corresponding to the determination result may be stored in the RAM 421.

The print controller 419 erases a signal for a nozzle that exhibits defective ejection from the recording data signal DATA for a block corresponding to the nozzle that exhibits defective ejection on the basis of the block signal BLE and the sensor selection signal SDATA corresponding to the nozzle that exhibits defective ejection stored in the RAM 421. The print controller 419 adds instead a signal for a non-ejection complementary nozzle to the recording data signal DATA for the block, and outputs the recording signal DATA to the signal generation unit 7.

<Description of Method of Determining Ejection State>

Figure 6A:
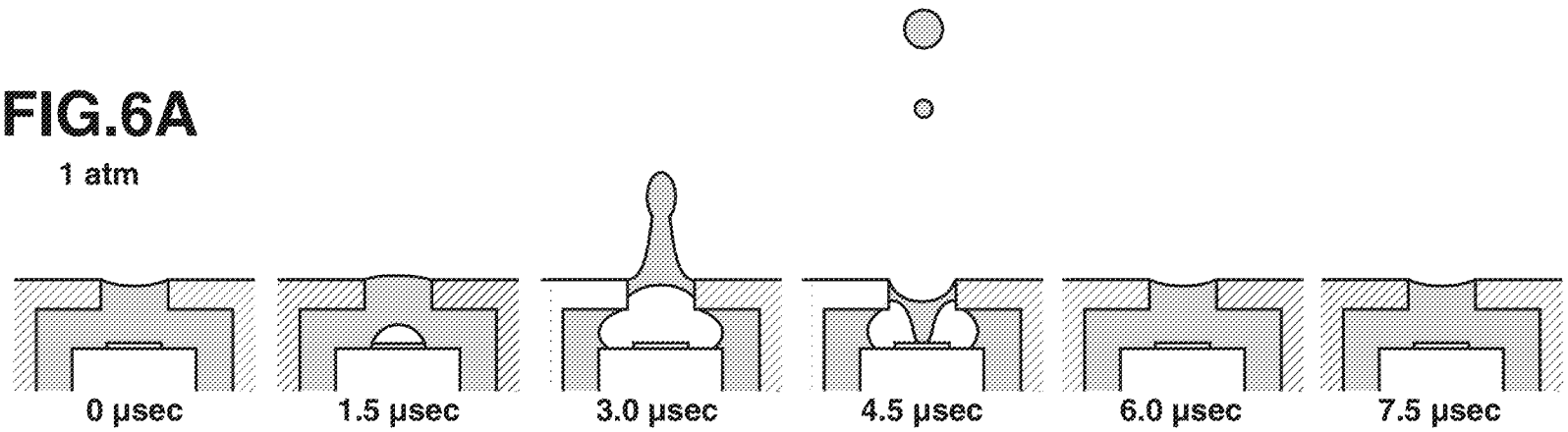
FIGS. 6A and 6B are schematic diagrams each illustrating an ejection state of normal ejection according to one or more aspects of the present disclosure.
Figure 6B:
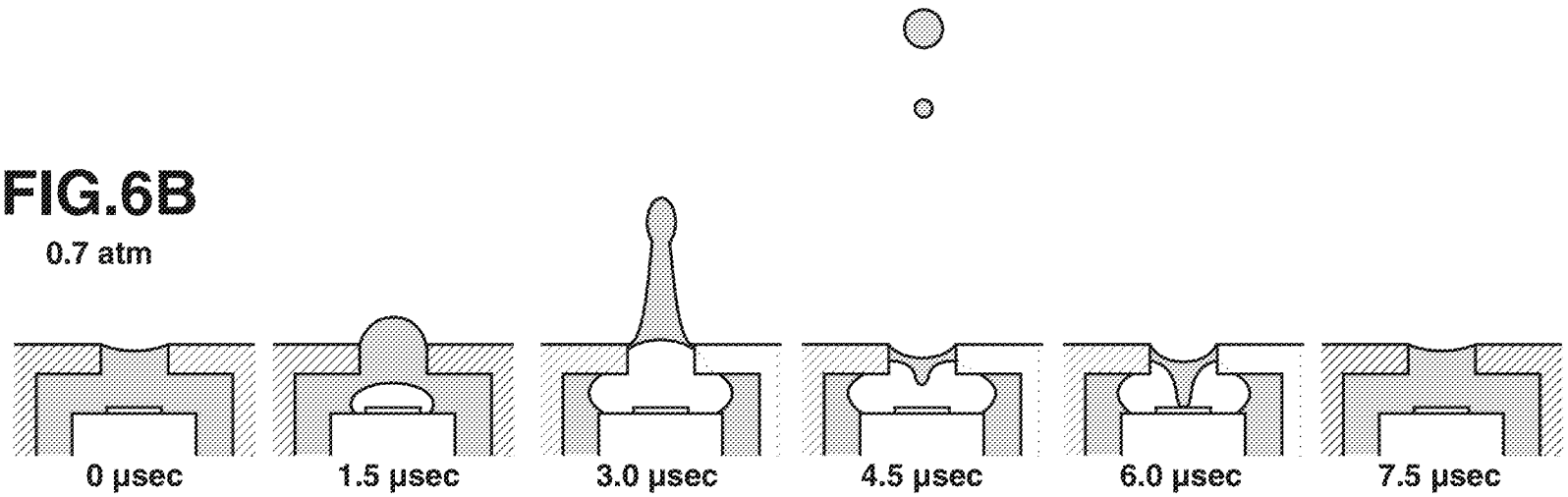

FIGS. 6A and 6B are schematic diagrams respectively illustrating ejection states of normal ejection on flatlands (under atmospheric pressure of 1 atm) and on highlands (under atmospheric pressure of 0.7 atm).

Figure 7A:
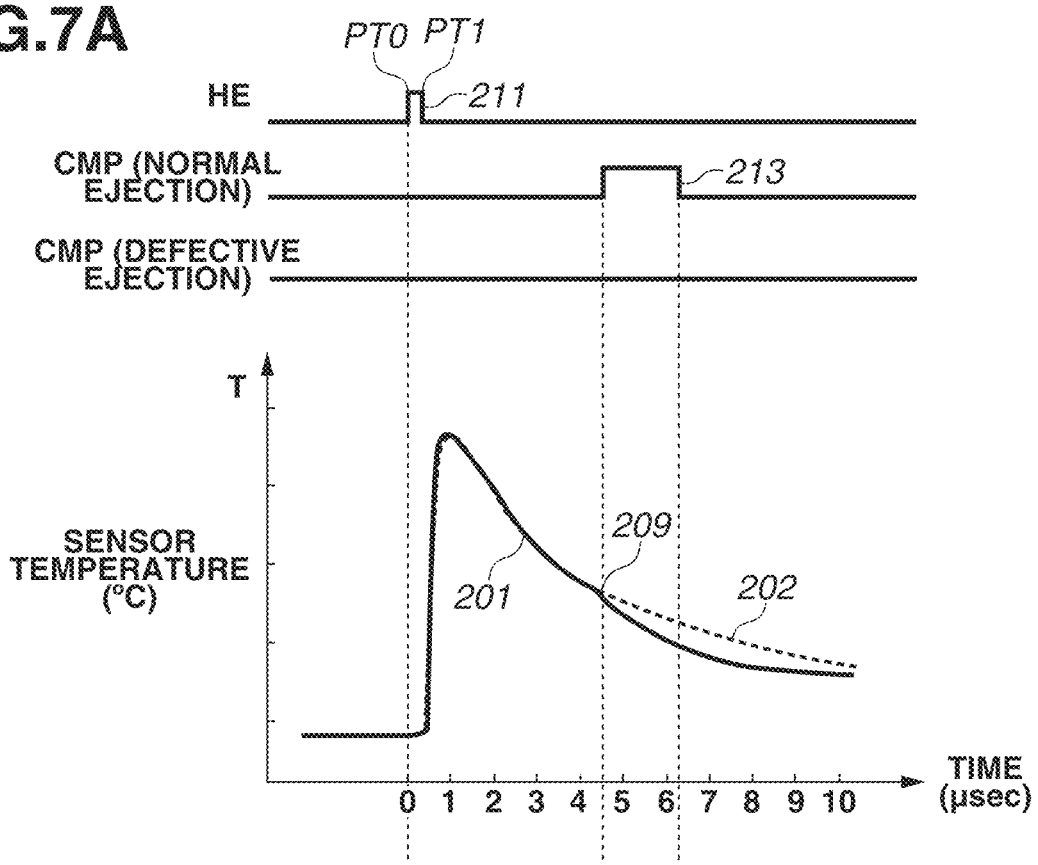
FIG. 7A is a diagram illustrating a temperature waveform and FIG. 7B is a diagram illustrating a waveform of a temperature change signal under atmospheric pressure of 1 atm according to one or more aspects of the present disclosure.
Figure 7B:
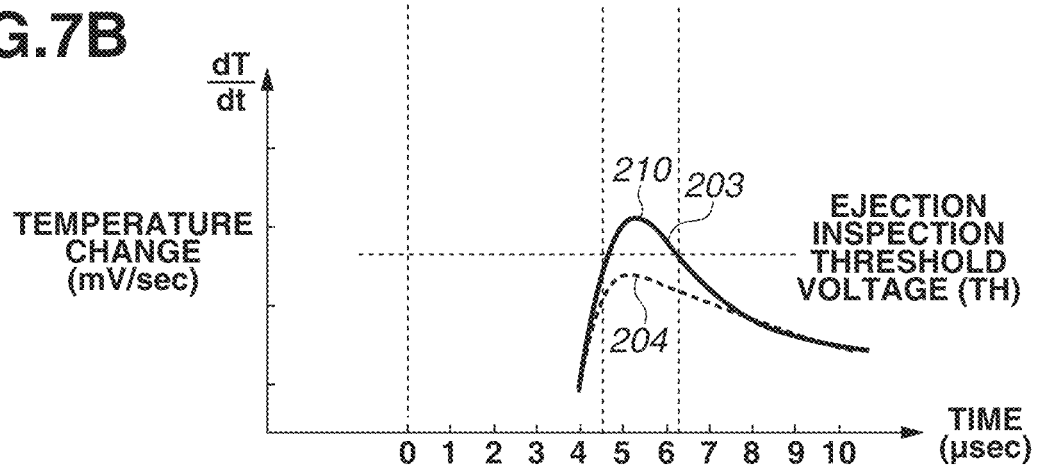

FIGS. 7A and 7B are diagrams respectively illustrating a temperature waveform and a waveform of a temperature change signal that are output from the temperature detection element 306 when the heat enable signal HE is input to the recording element 309 under the atmospheric pressure of 1 atm. FIG. 7A is a graph illustrating the temperature waveform, and FIG. 7B is a graph illustrating the temperature change signal. A pulse width of a driving pulse is set by determining a rise time and a fall time of the pulse. A case is cited where a rise time of a first driving pulse 211 is a rise time PT0, and a fall time of the first driving pulse 211 is a fall time PT1. The pulse width in this case corresponds to a length from the rise time PT0 to the fall time PT1.

While the temperature waveform is indicated by a temperature (° C.) in FIG. 7A, actually a constant current is supplied to the temperature detection element 306, and a voltage V between terminals of the temperature detection element 306 is detected. Since the detected voltage has a temperature dependency, the detected voltage is changed into and represented as a temperature in FIG. 7A. A temperature change signal (dT/dt) is represented as a temporal change of the detected voltage (mV/sec) in FIG. 7B.

As illustrated in FIG. 7A, if the first driving pulse 211 of the heat enable signal HE is applied to the recording element 309, the output waveform of the temperature detection element 306 becomes a waveform 201 in the case of normal ink ejection. In a temperature fall process detected by the temperature detection element 306, which is indicated by the waveform 201, the tail of a droplet of ejected ink is pulled back to the interface of the recording element 309 in the case of normal ink ejection due to a difference between bubbling pressure and outside atmospheric pressure and is in contact with the interface (outermost surface) of the recording element 309, thereby cooling the interface of the recording element 309. A feature point 209 appears in the waveform 201 due to the cooling of the interface (refer to 4.5 μsec in FIG. 6A). Then, the temperature falling rate rapidly increases in the waveform 201 at the feature point 209 and after. On the other hand, in the case of defective ejection, there is no contact of an ink droplet with the interface of the recording element 309 as illustrated at 4.5 μsec in FIG. 6A because ink is not ejected, and thus the interface of the recording element 309 is not cooled. Consequently, the feature point 209 that appears in the waveform 201 in the case of normal ejection does not appear. The output waveform of the temperature detection element 306 indicates a gradual decrease in the temperature falling rate in the temperature fall process as indicated by a waveform 202.

The graph of the temperature change signal illustrated in FIG. 7A indicates the temperature change signal (dT/dt). Waveforms 203 and 204 obtained by respectively converting the waveforms 201 and 202 from the temperature detection element 306 into the temperature change signals are illustrated. The waveform 203 is a waveform obtained by converting the waveform 201 in the case of normal ejection, and the waveform 204 is a waveform obtained by converting the waveform 202 in the case of defective ejection. A method of conversion to the temperature change signal is selected as appropriate for each system. The temperature change signal according to the present exemplary embodiment is a waveform output after the temperature waveform passes through a filter circuit (for one-time differentiation in this configuration) and an inversion amplifier.

In the waveform 203, a peak 210 attributable to a maximum temperature falling rate after the feature point 209 of the waveform 201 appears. The waveform (dT/dt) 203 is compared with the ejection inspection threshold voltage TETI that is preliminarily set in a comparator provided on the element substrate 5. In the case of normal ejection, there is a segment of time in which the waveform 203 is greater than or equal to the ejection inspection threshold voltage TH ($dT/dt \geq TH$), and a pulse 213 appears in a determination signal CMP.

In contrast, the feature point 209 does not appear in the waveform 202, so that the temperature falling rate is low and a peak appearing in the waveform 204 is lower than the ejection inspection threshold voltage TH. The waveform (dT/dt) 202 is also compared with the ejection inspection threshold voltage TH that is preliminarily set in the comparator provided on the element substrate 5. In the case of defective ejection, there is no segment of time in which the waveform 204 is greater than or equal to the ejection inspection threshold voltage TH. Thus, the pulse 213 does not appear in the determination signal CMP.

As described above, acquiring the determination signal CMP enables grasping of the ejection state of each nozzle. A result of detection based on the determination signal CMP is output as a determination result signal RSLT.

The ROM 420 of the print engine unit 417 of the recording apparatus preliminarily holds a value Dref corresponding to a voltage of the peak 210 in the case of normal ejection, and the ejection inspection threshold voltage TH is set as a relative value to the value Dref. In the present exemplary embodiment, the ejection inspection threshold voltage TH is set as a relative rank with respect to the value Dref. The value Dref corresponding to the voltage of the peak 210 in the case of normal ejection may be measured and updated at every predetermined timing. The predetermined timing referred to herein may be, for example, the number of supplied sheets, the number of recording dots, a time, an elapsed time period from the previous inspection, per print job, per print page, the time of replacement of the recording head, or the time of performing recovery processing of the recording head, and is set as appropriate for each system.

In the case of determining the ink ejection state in the present exemplary embodiment, the first driving pulse 211 is applied as one driving pulse for ejecting ink in FIGS. 7A and 7B. On the other hand, in the case of recording an image on the recording medium, a pre-pulse is applied to such an extent as not to eject ink before application of the driving pulse for ejecting ink to heat ink in the vicinity of the recording element 309, and then the driving pulse is applied. Applying the pre-pulse can broaden an ink region in which a temperature instantaneously reaches a film boiling temperature at the time of application of a main pulse subsequent to the pre-pulse. In the present exemplary embodiment as well, double pulses of the pre-pulse and the main pulse can be applied in the case of determining the ejection state.

<Issue Regarding Determination of Ejection State>

FIG. 6B is a diagram illustrating the ejection state under the atmospheric pressure of 0.7 atm. Similarly to FIG. 6A, a timing at which the driving pulse for heating the heater is applied is 0 μsec. Similarly to FIG. 6A, ink starts to bubble after elapse of 1.5 μsec and jets out around 3.0 μsec. At this time, since the atmospheric pressure is lower than 1 atm, a rate at which a bubble becomes large is faster than that in the case illustrated in FIG. 6A, and ink is ejected faster. After the ejection of ink, the tail of an ink droplet contacts the interface of the recording element 309. Since the outside atmospheric pressure is low, force that pulls back the tail is smaller than that under the atmospheric pressure of 1 atm. Thus, the tail does not contact the interface of the recording element 309 yet around 4.5 μsec at which the tail contacts the interface thereof under the atmospheric pressure of 1 atm. Subsequently, the trail of the ink droplet contacts the interface of the recording element 309 around 6.0 μsec. Ink is refilled at 7.5 μsec or after, and the ejection state returns to the state before the bubbling.

Figure 8A:
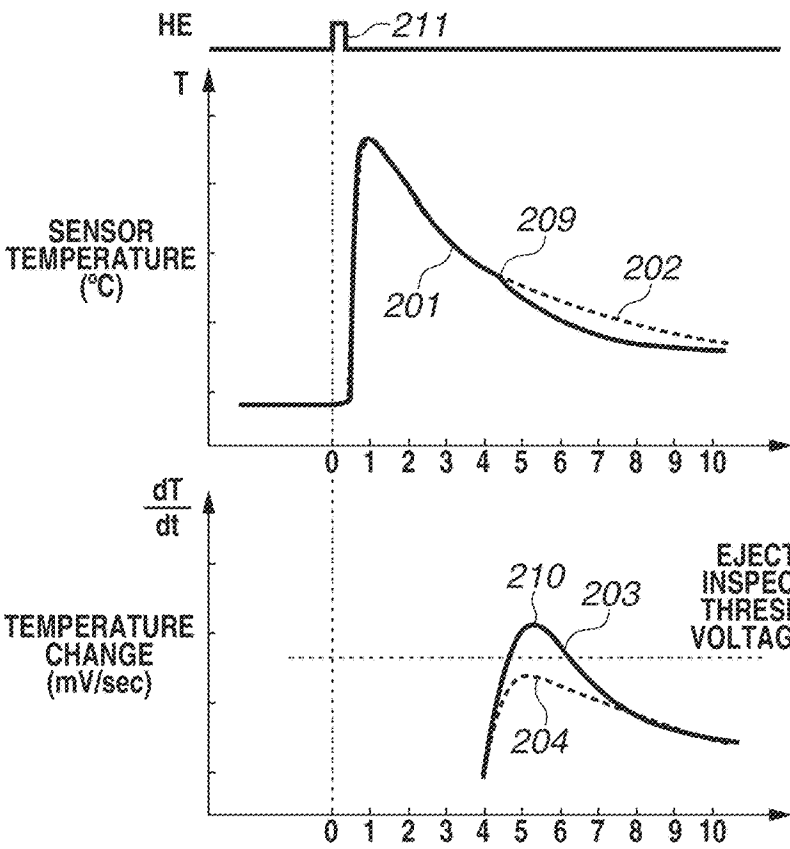
FIG. 8A includes diagrams illustrating a temperature waveform and a waveform of a temperature change signal in a case where a driving pulse under the atmospheric pressure of 1 atm is applied.
Figure 8B:
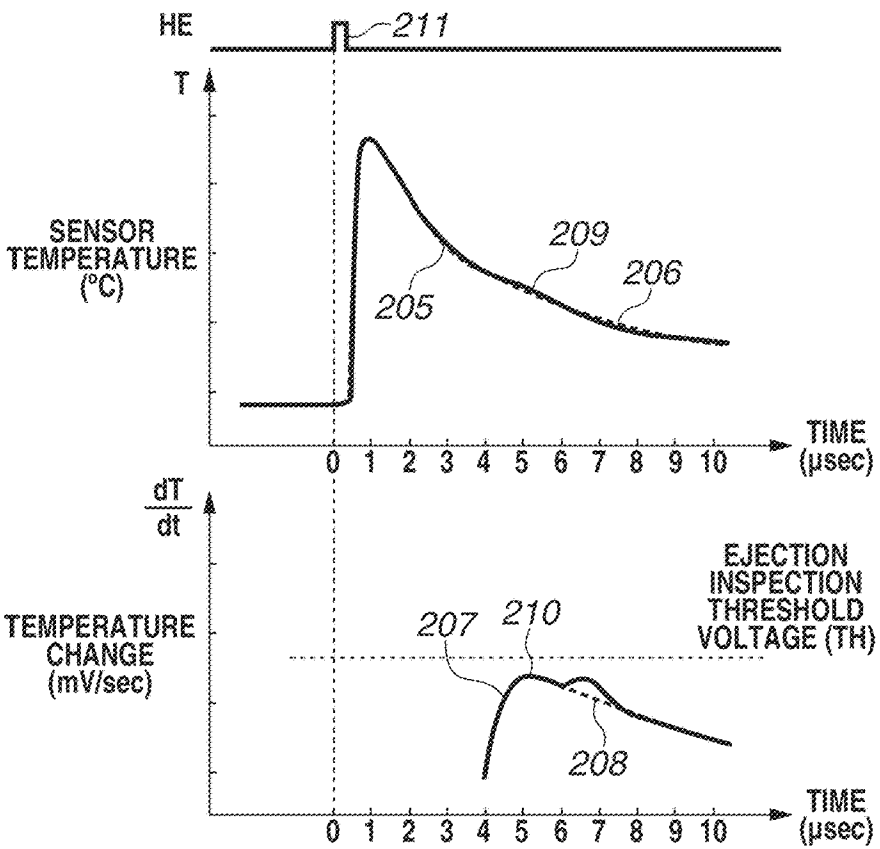
FIG. 8B includes diagrams illustrating a temperature waveform and a waveform of a temperature change signal in a case where the same driving pulse as that of FIG. 8A is applied under atmospheric pressure of 0.7 atm.

FIGS. 8A and 8B each includes diagrams illustrating a temperature waveform (sensor temperature: T) and a waveform of a temperature change signal (dT/dt) in the case of applying the first driving pulse 211 on flatlands (under the atmospheric pressure of 1 atm) and on highlands (under the atmospheric pressure of 0.7 atm, respectively. The ejection state at this time is as illustrated in FIGS. 6A and 6B.

FIG. 8A is similar to FIGS. 7A and 7B and includes diagrams illustrating t sensor temperature waveform and the waveform of the corresponding temperature change signal under the atmospheric pressure of 1 atm. The waveform 201 of the sensor temperature in the case of normal ink ejection and the waveform 203 of the temperature change signal at this time are indicated by solid lines. The waveform 202 and the waveform 204 of the temperature change signal indicated by dotted lines are waveforms in the case of defective ejection under the atmospheric pressure of 1 atm.

FIG. 8B includes diagrams illustrating the sensor temperature waveform and the waveform of the corresponding temperature change signal under the atmospheric pressure of 0.7 atm. A waveform 205 of a sensor temperature in the case of normal ink ejection and a waveform 207 of the temperature change signal at this time are indicated by solid lines. A temperature waveform 206 and a waveform 208 of the temperature change signal indicated by dotted lines are waveforms in the case of defective ejection under the atmospheric pressure of 0.7 atm. An appearance timing of the feature point 209 of the waveform 205 that appears in the case of normal ejection under the atmospheric pressure of 0.7 atm is later than an appearance timing of the feature point 209 of the waveform 201 that appears in the case of normal ejection under the atmospheric pressure of 1 atm. The peak 210 of the waveform 207 of the temperature change signal in the case of normal ejection under the atmospheric pressure of 0.7 atm is lower than the peak 210 of the waveform 203 of the temperature change signal in the case of normal ejection under the atmospheric pressure of 1 atm. The reason for this can be considered as follows. As illustrated in FIGS. 6A and 6B, a timing at which the tail of an ink droplet contacts the interface of the recording element 309 becomes later as the atmospheric pressure is lower. Thus, a period of time from application of the first driving pulse 211 to contacting of the tail becomes longer. As a result, a temperature of the recording element 309 at the time of the contacting of the tail under the atmospheric pressure of 0.7 atm is lower than that under the atmospheric pressure of 1 atm, and an amount of change in the temperature falling rate becomes smaller.

Since the ejection inspection threshold voltage TH is set higher than the peak of the waveform 207 illustrated in FIG. 8B, even normal ejection may be determined as defective ejection in the case of FIG. 8B. In the case of defective ejection, tailing of ink does not appear because ink is not ejected, and the temperature waveform of the sensor and the waveform of the temperature change signal hardly change between the atmospheric pressure of 1 atm and the atmospheric pressure of 0.7 atm because of less influence of the outside atmospheric pressure. As illustrated in FIG. 8B, there is almost no difference in peak value of the temperature change signal (dT/dt) between the case of normal ejection and the case of defective ejection, and the ejection inspection threshold voltage TH cannot be set appropriately between the waveforms of the temperature change signal in the case of normal ejection and in the case of defective ejection. Thus, the ejection state under the atmospheric pressure of 0.7 atm cannot be determined correctly by the same method as that under the atmospheric pressure of 1 atm.

As described above, there is a possibility that the ejection state cannot be determined correctly using the driving pulse and the ejection inspection threshold voltage on an assumption of predetermined atmospheric pressure when atmospheric pressure is different from the predetermined atmospheric pressure. In a case where the ejection state cannot be determined correctly, recovery processing to recover the ejection state or non-ejection complementary processing cannot be performed appropriately, which may lead to deterioration of image quality. The present exemplary embodiment is directed to determining the ejection state correctly even if the atmospheric pressure changes.

<Determination of Ejection State>

In the present exemplary embodiment, a temperature of the recording element 309 when the tail of an ink droplet contacts the recording element 309 is maintained to be high, so that an amount of change in the temperature falling rate due to the contacting of the ink droplet becomes large.

Figure 9A:
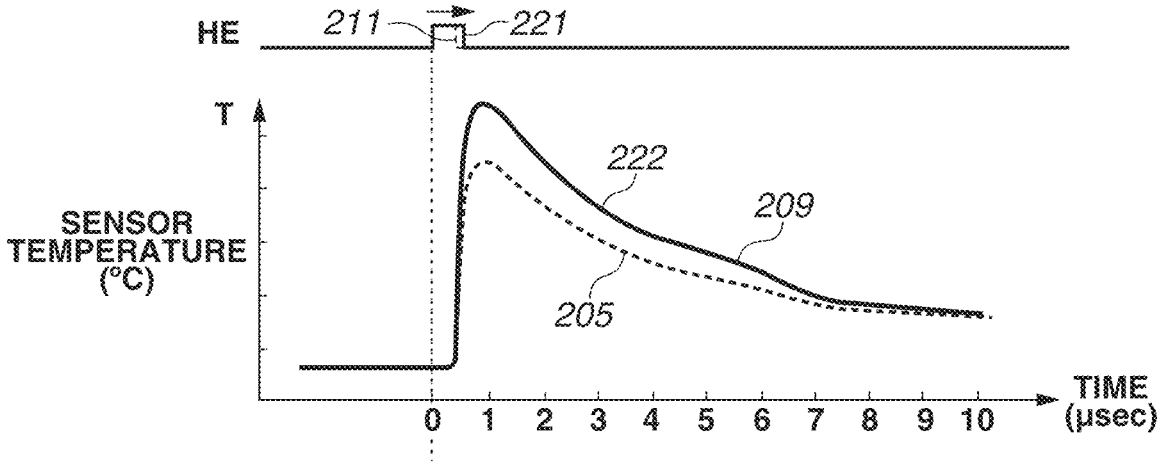
FIG. 9A is a diagram illustrating a temperature waveform and FIG. 9B is a diagram illustrating a waveform of a temperature change signal in the case of normal ejection under the atmospheric pressure of 0.7 atm.
Figure 9B:
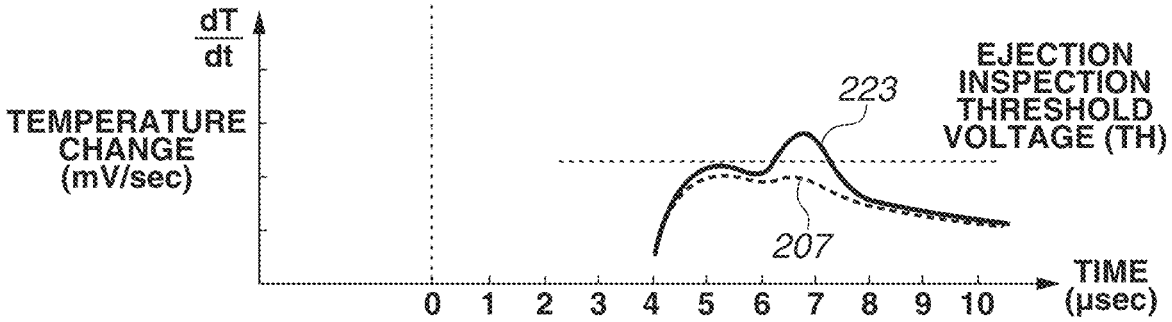

FIG. 9A is a diagram illustrating a temperature waveform and FIG. 9B is a diagram illustrating a waveform of a temperature change signal n the case of normal ejection under the atmospheric pressure of 0.7 atm.

A driving pulse 221 to be applied in the present exemplary embodiment is indicated by a solid line, and the first driving pulse 211 illustrated in FIGS. 8A and 8B is indicated by a dotted line. FIG. 9A is a graph illustrating the temperature waveform, and FIG. 9B is a graph illustrating the temperature change signal. In each of FIGS. 9A and 9B, the waveform indicated by a solid line is a waveform that appears when the recording element 309 is driven by the driving pulse 221, and the waveform indicated by a dotted line is a waveform that appears when the recording element 309 is driven by the first driving pulse 211. The driving pulse 221 in FIGS. 9A and 9B has a pulse width, i.e., a width from a rising edge to a falling edge, larger than that of the first driving pulse 211 in FIGS. 8A and 8B. Since a timing at which the feature point 209 appears under low atmospheric pressure is later than that under the atmospheric pressure of 1 atm, increasing the pulse width as with the driving pulse 221 can prevent a temperature of the recording element 309 from being low when the tail of an ink droplet contacts the recording element 309. As illustrated in FIG. 9A, a temperature of the recording element 309 at a timing of the feature point 209, which is a timing of the contacting of an ink droplet, in a waveform 222 that appears when the recording element 309 is driven by the driving pulse 221 is higher than that in the waveform 205 that appears when the recording element 309 is driven by the first driving pulse 211. As illustrated in FIG. 9B, a peak value of a waveform 223 of the temperature change signal obtained by performing differential processing on the waveform 222 at the time of the contacting of an ink droplet with the recording element 309 in a state where the recording element 309 is kept at a high temperature is greater than a peak value of the waveform 207 of the temperature change signal in the case of FIG. 8B. In the case of defective ejection when the driving pulse 221 is applied to the recording element 309, the waveform of the temperature change signal becomes similar to the waveform 208 in the case of defective ejection in FIG. 8B. Since applying the driving pulse 221 to the recording element 309 to drive the recording element 309 makes a difference between the peak value in the case of normal ejection and the peak value in the case of defective ejection in each waveform of the temperature change signal, setting the ejection inspection threshold voltage TH between the two peak values enables determination of the ejection state.

Figure 10:
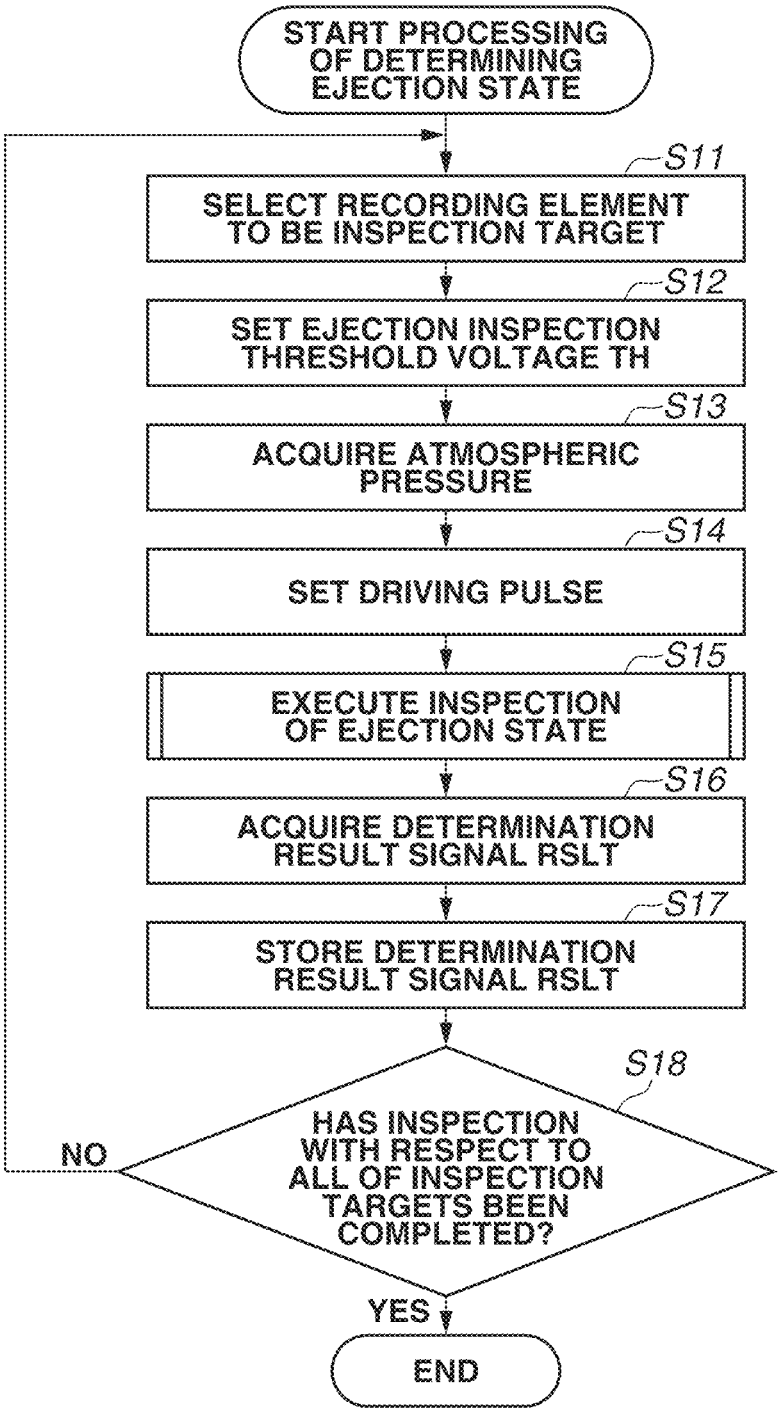
FIG. 10 is a flowchart illustrating processing of determining an ink ejecting state according to one or more aspects of the present disclosure.

FIG. 10 is a flowchart illustrating processing of determining the ink ejection state by setting different driving pulses depending on atmospheric pressure. The processing is implemented, for example, by the print controller 419 loading a program stored in the ROM 420 to the RAM 421 and executing the program.

First, in step S11, the print controller 419 designates the recording element 309 to be an inspection target. Based on designation, the signal generation unit 7 generates the sensor selection signal SDATA and selects the recording element 309 to be the inspection target. Subsequently in step S12, the print controller 419 sets the ejection inspection threshold voltage TH of the selected recording element 309. As the ejection inspection threshold voltage TH, the print controller 419 reads the peak value Dref of the temperature change signal of each nozzle in the case of normal ejection that is preliminarily stored in the ROM 420, and sets a voltage that is lower by a predetermined amount than the peak value Dref. Since there is a possibility that the peak value Dref of the temperature change signal changes depending on a usage status of the recording apparatus, the peak value Dref is desirably updated at every predetermined timing. The predetermined timing may be, for example, the number of supplied sheets, the number of recording dots, a time, an elapsed time period from the previous inspection, per print job, per print page, the time of replacement of the recording head, or the time of performing recovery processing of the recording head.

Subsequently, in step S13, the print controller 419 acquires atmospheric pressure from the atmospheric pressure sensor 428 functioning as an acquisition unit. However, the print engine unit 417 may not necessarily include the atmospheric pressure sensor 428 if the print controller 419 function as an acquisition unit and can acquire information from which the atmospheric pressure can be inferred. Alternatively, the print controller 419 may acquire, for example, information about a height above sea level, a latitude and longitude, or the name of a region. The print controller 419 may acquire information about atmospheric pressure at a position acquired on the basis of these pieces of information from a host computer or the like, or may store information about the atmospheric pressure corresponding to the information to be acquired in the ROM 407 in advance and infer the atmospheric pressure from the information such as the height above sea level. These pieces of information can be acquired from a device such as the GPU or by a method of inputting the information by the user on the operation panel 404.

In step S14, the print controller 419 sets, as a setting unit, a driving pulse to be applied to determine the ejection state based on the information about the atmospheric pressure acquired in step S13. The driving pulse is set in accordance with a table illustrated in FIG. 11. A timing at which the feature point 209 appears becomes later as the atmospheric pressure becomes lower. Thus, in the table illustrated in FIG. 11, a pulse width of the driving pulse to be applied is increased as the timing becomes later, so that a heating amount after the bubbling is increased. Alternatively, the driving pulse may be set based on a function indicated by a line of a primary expression, a curve of a quadratic expression, or the like instead of using the table illustrated in FIG. 11.

In step S15, the print controller 419 executes inspection of the ejection state on the basis of the ejection inspection threshold voltage TH set in step S14. In the ejection inspection, the driving pulse 221 described in FIGS. 9A and 9B is applied to the recording element 309 to eject ink. Thus, a determination signal is obtained from the waveform of the temperature change signal at the time of ejecting ink and the set ejection inspection threshold voltage TH. The element substrate 5 generates the determination result signal RSLT on the basis of the obtained determination signal, and inputs the determination result signal RSLT to the determination result extraction unit 9.

In step S16, the determination result extraction unit 9 determines whether the determination result signal RSLT input from the element substrate 5 in step S15 is "0" or "1". The determination result signal RSLT being "1" indicates that the peak value Dref of the temperature change signal is the ejection inspection threshold voltage TH or above, and the determination result signal RSLT being "0" indicates that the peak signal Dref of the temperature change signal is below the ejection inspection threshold voltage TH.

In step S17, the determination result extraction unit 9 stores a result of the determination made in step S16 in the RAM 421 in association with the selected recording element 309.

In step S18, the print controller 419 determines whether the inspection has been completed with respect to all of the recording elements 309 of the nozzle that are inspection targets. If it is determined that the inspection has not been completed with respect to all of the inspection targets (NO in step S18), the processing returns to step S11. In step S11, the print controller 419 selects another recording element 309 that has not been inspected and executes the processing in step S12 and subsequent steps. On the other hand, if it is determined that the inspection has been completed with respect to all of the inspection targets (YES in step S18), the processing of determining the ejection state illustrated in FIG. 10 ends. After the completion of the processing of determining the ejection state, the print controller 419 executes the recovery processing to recover the ejection state or the like based on the determination result signal RSLT of each recording element 309.

As described above, switching the driving pulse to be applied depending on atmospheric pressure to determine the ejection state enables a temperature of the recording element when the tail of an ink droplet contacts the recording element to be kept high. This enables a rapid increase in the temperature falling rate of the recording element and enables correct determination of the ejection state irrespective of the atmospheric pressure. Correct determination of the ejection state enables appropriate execution of the recovery processing and the non-ejection complementary processing and enables prevention of deterioration in image quality.

In a second exemplary embodiment, a description will be given of a mode of applying a second driving pulse different from the first driving pulse to eject ink as a driving pulse to be applied in determination of the ejection state. A description of a part similar to that in the first exemplary embodiment will be omitted.

Figure 12A:
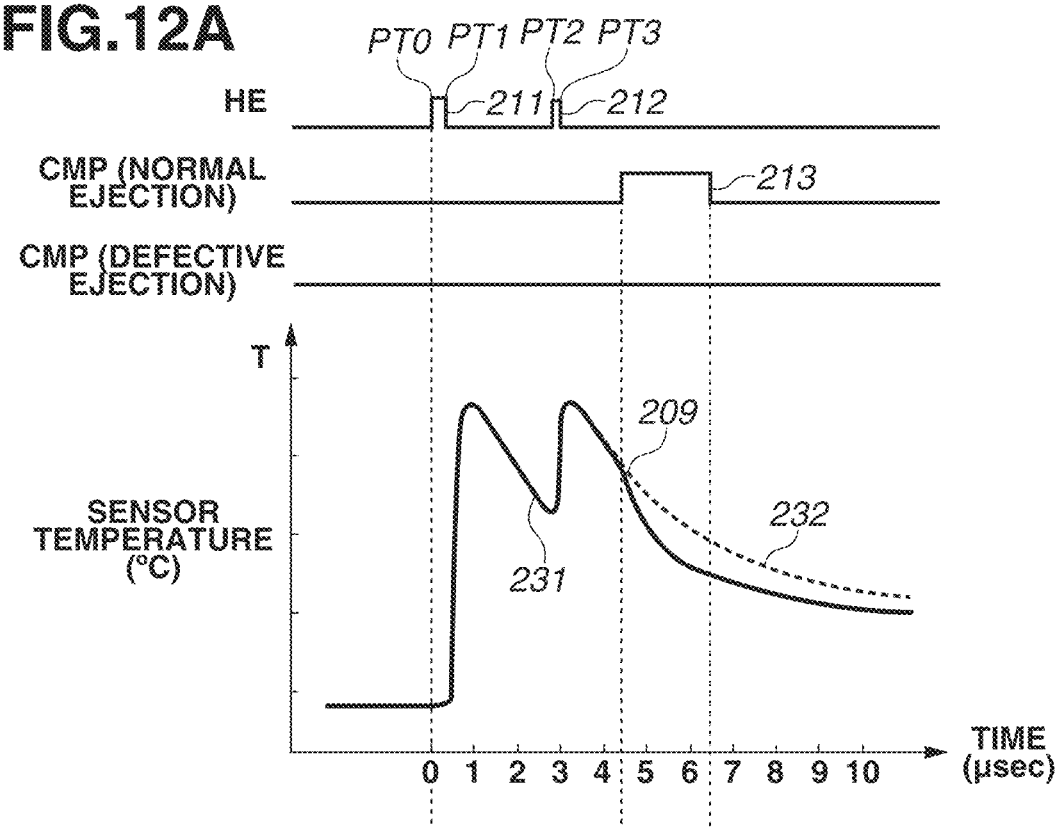
FIG. 12A is a diagram illustrating a temperature waveform and FIG. 12B is a diagram illustrating a waveform of a temperature change signal under atmospheric pressure of 1 atm according to one or more aspects of the present disclosure.
Figure 12B:
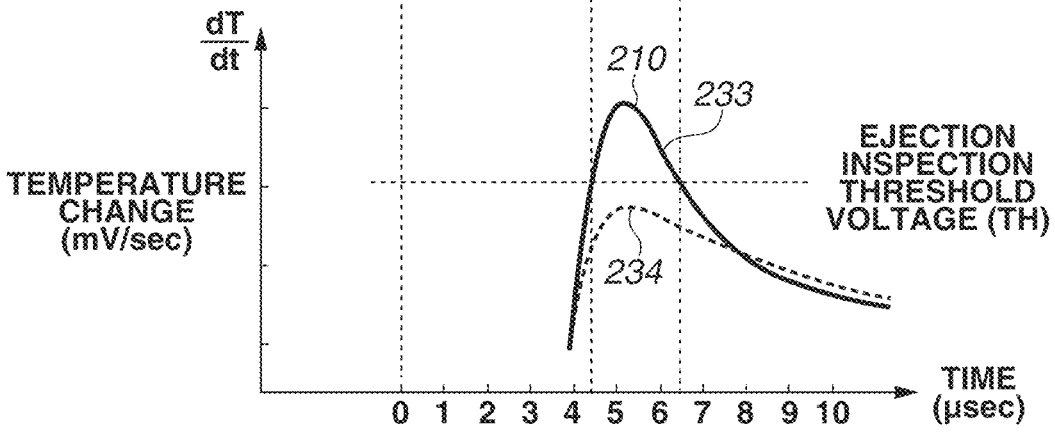

FIGS. 12A and 12B are diagrams respectively illustrating a temperature waveform and a waveform of a temperature change signal that are output from the temperature detection element 306 in response to input of the heat enable signal HE according to the present exemplary embodiment to the recording element 309 under the atmospheric pressure of 1 atm. As illustrated in FIGS. 12A and 12B, in the present exemplary embodiment, the second driving pulse different from the first driving pulse is applied to eject ink when determining the ejection state. A case is cited where a rise time of the first driving pulse 211 is the rise time PTO, a fall time of the first driving pulse 211 is the fall time PT1, a rise time of a second driving pulse 212 is a rise time PT2, and a fall time of the second driving pulse 212 is a fall time PT3.

By applying the second driving pulse to the recording element 309, the recording element 309 is reheated immediately before the tail of an ink droplet contacts the interface of the recording element 309. Thus, the temperature falling rate increases more sharply than that in the case where only the first driving pulse is applied as illustrated in FIGS. 7A and 7B according to the first exemplary embodiment, and the peak 210 of a waveform 233 of the temperature change signal in the case of normal ejection is higher than the peak 210 of the waveform 203 illustrated in FIG. 7B. In contrast, the peak of a waveform 234 of the temperature change signal in the case of defective ejection is almost the same as the waveform 204 illustrated in FIG. 7B. Consequently, it can be found that a difference in peak value between the case of normal ejection and the case of defective ejection is larger than that according to the first exemplary embodiment. This enables setting of the ejection inspection threshold voltage TH to a value with a low probability of erroneous determination of the ejection state due to noise or the like, and enables a lower probability of erroneous determination than that of the first exemplary embodiment.

There is a possibility that a system that applies the second driving pulse as illustrated in FIGS. 12A and 12B cannot correctly determine the ejection state depending on atmospheric pressure as described with reference to FIGS. 8A and 8B. The present exemplary embodiment increases a pulse width of the second driving pulse in a case where atmospheric pressure is low.

Figure 13A:
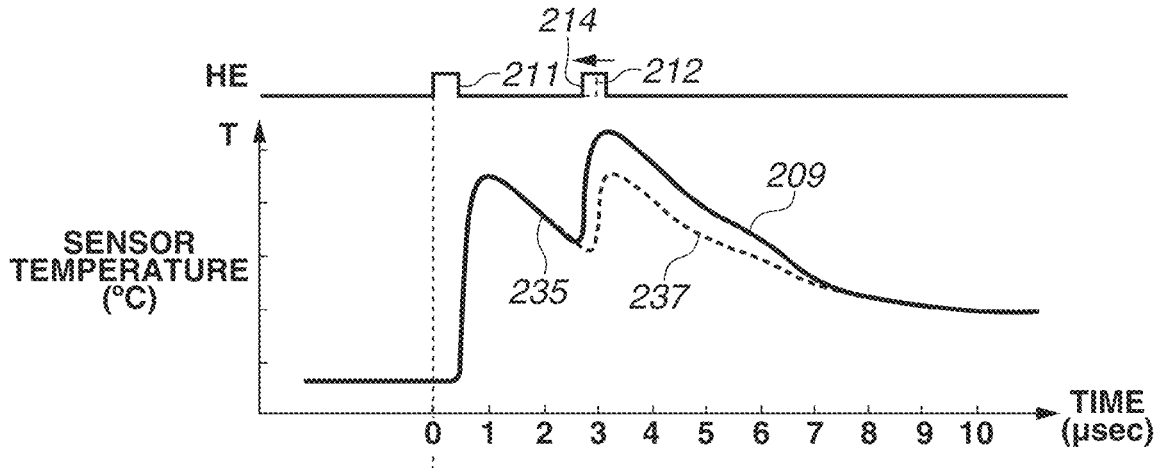
FIG. 13A is a diagram illustrating a temperature waveform and FIG. 13B is a diagram illustrating a waveform of a temperature change signal in the case of normal ejection under atmospheric pressure of 0.7 atm.
Figure 13B:
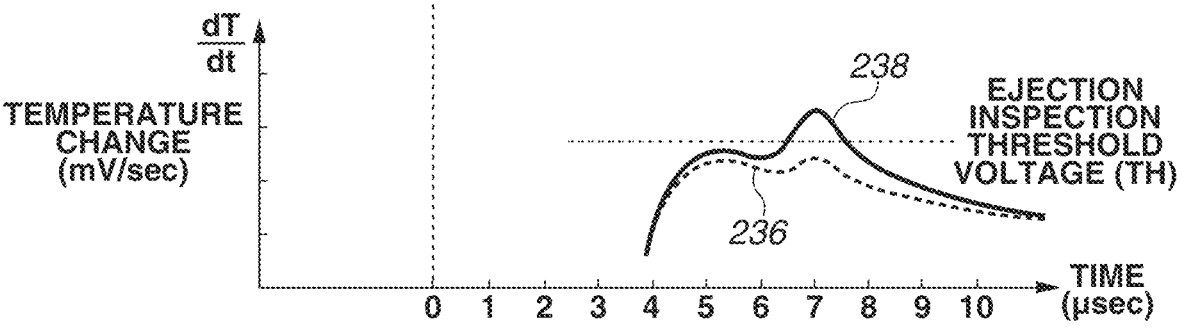

FIG. 13A is a diagram illustrating a temperature waveform and FIG. 13B is a diagram illustrating a waveform of a temperature change signal in the case of normal ejection under the atmospheric pressure of 0.7 atm.

A second driving pulse 214 to be applied in the present exemplary embodiment is indicated by a solid line, and the second driving pulse 212 illustrated in FIGS. 12A and 12B is indicated by a dotted line. FIG. 13A is a graph illustrating the temperature waveform, and FIG. 13B is a graph illustrating the temperature change signal. In each of FIGS. 13A and 13B, the waveform indicated by a solid line is a waveform that appears when the recording element 309 is driven by the second driving pulse 214, and the waveform indicated by a dotted line is the waveform when the recording element 309 is driven by the second driving pulse 212. A pulse width of the second driving pulse 214 illustrated in FIGS. 13A and 13B is larger than that of the second driving pulse 212 illustrated in FIGS. 12A and 12B. Since a timing at which the feature point 209 appears under low atmospheric pressure is later than that under the atmospheric pressure of 1 atm, increasing the pulse width can prevent a temperature of the recording element 309 from being low when the tail of an ink droplet contacts the recording element 309. As illustrated in FIG. 13A, a temperature of the recording element 309 at a timing of the feature point 209, which is a timing of the contacting of an ink droplet, is higher in a waveform 235 that appears when the recording element 309 is driven by the second driving pulse 214 than in a waveform 237 that appears when the recording element 309 is driven by the second driving pulse 212. As illustrated in FIG. 13B, a peak value of a waveform 238 of the temperature change signal obtained by performing differential processing on the waveform 235 at the time of the contacting of an ink droplet with the recording element 309 in the state where the recording element 309 is kept at a high temperature is greater than a peak value of a waveform 236 of the temperature change signal in the case of using the second driving pulse 212. In the case of defective ejection when the second driving pulse 214 is applied to the recording element 309, a peak value of the waveform of the temperature change signal becomes almost the same as the peak value of the waveform 236. Since applying the second driving pulse 214 to the recording element 309 to drive the recording element 309 makes a difference between the peak value in the case of normal ejection and the peak value in the case of defective ejection in each waveform of the temperature change signal, setting the ejection inspection threshold voltage TH between the two peak values enables determination of the ejection state.

The processing of determining the ejection state is performed in a similar manner to that in the first exemplary embodiment illustrated in FIG. 10, and thus a description thereof is omitted. However, in step S14 when the driving pulse depending on the atmospheric pressure acquired in step S13 is set, the setting is made on the basis of a table illustrated in FIG. 14. In the table illustrated in FIG. 14, the first driving pulse is not changed depending on atmospheric pressure, and a pulse width of the second driving pulse increases as atmospheric pressure becomes lower. Alternatively, the first driving pulse may be changed depending on atmospheric pressure. Furthermore, in FIG. 14, the fall time PT3 of the second driving pulse is set to be constant, and the rise time PT2 of the second driving pulse is changed. A method of increasing the pulse width of the second driving pulse is not limited thereto. Alternatively, a table may be employed in which the rise time PT2 is set to be constant while the fall time PT3 is changed, or both the rise time PT2 and the fall time PT3 are changed. Yet alternatively, the driving pulse may be set by a function instead of the table, similarly to the first exemplary embodiment.

Figure 15A:
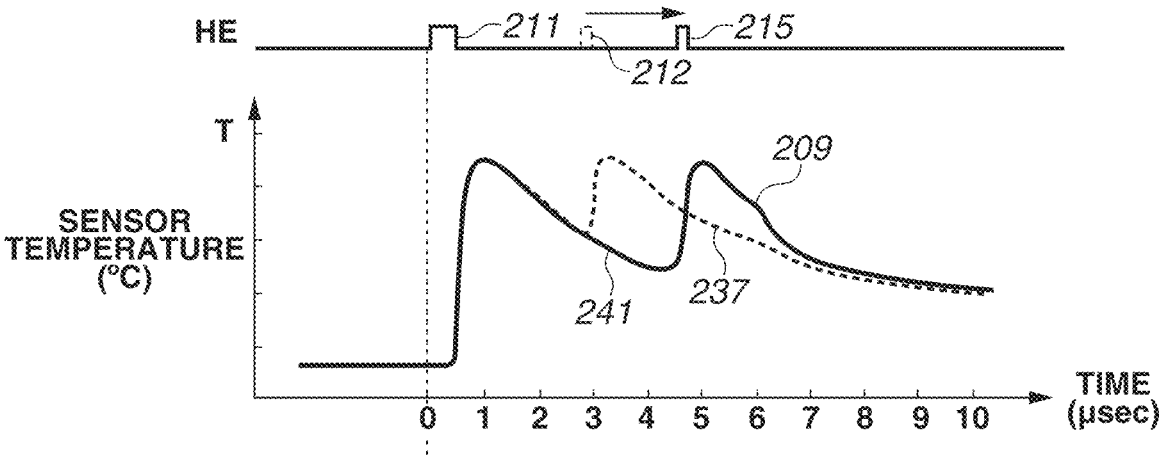
FIG. 15E is a diagram illustrating a temperature waveform and FIG. 15B is a diagram illustrating a waveform of a temperature change signal in the case of changing a timing of applying a second driving pulse under atmospheric pressure of 0.7 atm.
Figure 15B:
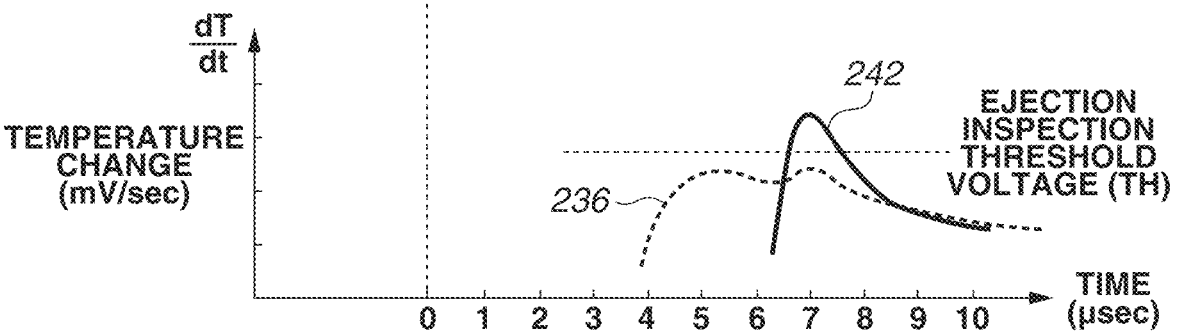

In the second exemplary embodiment, the temperature of the recording element 309 is maintained to be high at the time of contacting of an ink droplet by increasing the pulse width of the second driving pulse. In a third exemplary embodiment, the temperature is maintained to be high by changing a timing to apply the second driving pulse, and an amount of change in the temperature falling rate at the feature point is increased. A description of a part similar to that in the exemplary embodiments described above is omitted FIG. 15A is a diagram illustrating a temperature waveform and FIG. 15B is a diagram illustrating a waveform of a temperature change signal in the case of changing a timing of applying the second driving pulse under the atmospheric pressure of 0.7 atm. The waveform 237 illustrated in FIG. 15A by a dotted line is a waveform that appears when the second driving pulse is applied to the recording element 309 under the atmospheric pressure of 0.7 at the same timing as that when the second driving pulse is applied to the recording element 309 under the atmospheric pressure of 1 atm. A waveform obtained by performing differential processing on the waveform 237 is the waveform 236 of the temperature change signal illustrated in FIG. 15B. A waveform 241 illustrated in FIG. 15A by a solid line is a temperature waveform obtained by applying a second driving pulse 215 at a later timing than the timing of the second driving pulse 212 to drive the recording element 309. A waveform obtained by performing differential processing on the waveform 241 is a waveform 242 of the temperature change signal illustrated in FIG. 15B. By bringing the timing of applying the second driving pulse close to the timing at which the feature point 209 appears allows the timing at which the feature point 209 appears to come in a state where the recording element 309 is at a high temperature. This makes an amount of change in the temperature falling rate at the feature point 209 of the waveform 241 larger than that at the feature point 209 of the waveform 237. Accordingly, a peak value of the waveform 242 of the temperature change signal is larger than the peak value of the waveform 236 of the temperature change signal. As described in the second exemplary embodiment, in the case of defective ejection, a peak value when the second driving pulse 215 is applied to the recording element 309 to drive the recording element 309 under the atmospheric pressure of 0.7 atm is almost the same as the peak value of the waveform 236. Setting the ejection inspection threshold voltage TH between the peak value in the case of normal ejection and the peak value in the case of defective ejection enables determination of the ejection state.

The processing of determining the ejection state is performed in a similar manner to that in the first exemplary embodiment illustrated in FIG. 10, and thus a description thereof is omitted. However, in step S14 when the driving pulse depending on the atmospheric pressure acquired in step S13 is set, the setting is made on the basis of a table illustrated in FIG. 16. In the table illustrated in FIG. 16, the first driving pulse is not changed depending on atmospheric pressure, and a timing of the rise time PT2 of the second driving pulse becomes later as atmospheric pressure becomes lower. In the table illustrated in FIG. 16, the pulse width of the second driving pulse is 0.30 μsec regardless of atmospheric pressure, but the pulse width may be changed. Alternatively, the driving pulse may be set by a function instead of the table, similarly to the first exemplary embodiment.

In the exemplary embodiments described above, by changing a start time and end time of applying the driving pulse, the temperature of the recording element 309 around the timing at which the feature point 209 appears is controlled. However, a control target is not limited to the time. For example, a similar effect can be obtained by increasing a voltage of a pulse to be applied to the recording element 309.

According to the exemplary embodiments described above, by changing the pulse to be applied to the recording element after the ejection of ink depending on the surrounding atmospheric pressure, the ink ejection state can be correctly determined even if the surrounding atmospheric pressure changes.

Other Embodiments

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, the scope of the following claims is to be accorded the broadest interpretation so as to encompass all such modifications and equivalent structures and functions.

This application claims the benefit of Japanese Patent Application No. 2020-015181, filed Jan. 31, 2020, which is hereby incorporated by reference herein in its entirety.

What is claimed is:

1. A recording apparatus, comprising:

a recording head including a plurality of ejection ports and a recording element provided at a position corresponding to each of the ejection ports and configured to generate heat energy, the recording head being configured to eject ink from the ejection ports by driving of the recording element;

a driving unit configured to apply a driving pulse to drive the recording element;

a temperature detection unit configured to detect a temperature change in a vicinity of the recording element when the recording element is driven by application of a driving pulse by the driving unit to eject ink;

a determination unit configured to determine an ink ejection state of each of the ejection ports on a basis of the temperature change detected by the temperature detection unit;

an acquisition unit configured to acquire information about atmospheric pressure around the recording head; and a setting unit configured to, when the determination unit determines the ink ejection state, set the driving pulse to be applied by the driving unit to the recording element on a basis of the information about the atmospheric pressure acquired by the acquisition unit.

2. The recording apparatus according to claim 1, wherein the temperature detection unit is configured to apply one first driving pulse to drive the recording element to detect the temperature change, and wherein the setting unit is configured to change a pulse width of the first driving pulse on the basis of the information about the atmospheric pressure acquired by the acquisition unit.

3. The recording apparatus according to claim 2, wherein the setting unit is configured to set the first driving pulse so that a pulse width of the first driving pulse to be set in a case where atmospheric pressure indicated by the information about the atmospheric pressure acquired by the acquisition unit is second atmospheric pressure lower than first atmospheric pressure is larger than a pulse width of the first driving pulse to be set in a case where the atmospheric pressure indicated by the information about the atmospheric pressure acquired by the acquisition unit is first atmospheric pressure.

4. The recording apparatus according to claim 1, wherein the driving unit is configured to, when the determination unit determines the ink ejection state, apply, to the recording element, a first driving pulse to eject ink and a second driving pulse after the first driving pulse to eject ink.

5. The recording apparatus according to claim 4, wherein the setting unit is configured to change a pulse width of the second driving pulse on the basis of the information about the atmospheric pressure acquired by the acquisition unit.

6. The recording apparatus according to claim 5, wherein the setting unit is configured to set the second driving pulse so that a pulse width of the second driving pulse to be set in a case where atmospheric pressure indicated by the information about the atmospheric pressure acquired by the acquisition unit is second atmospheric pressure lower than first atmospheric pressure is larger than a pulse width of the second driving pulse to be set in a case where the atmospheric pressure indicated by the information about the atmospheric pressure acquired by the acquisition unit is the first atmospheric pressure.

7. The recording apparatus according to claim 4, wherein the setting unit is configured to change a time period from application of the first driving pulse to application of the second driving pulse on the basis of the information about the atmospheric pressure acquired by the acquisition unit.

8. The recording apparatus according to claim 7, wherein the setting unit is configured to set the second driving pulse so that a time period from the application of the first driving pulse to the application of the second driving pulse is longer for the second driving pulse to be set in a case where atmospheric pressure indicated by the information about the atmospheric pressure acquired by the acquisition unit is second atmospheric pressure lower than first atmospheric pressure than for the second driving pulse to be set in a case where the atmospheric pressure indicated by the information about the atmospheric pressure acquired by the acquisition unit is the first atmospheric pressure.

9. The recording apparatus according to claim 1, wherein the setting unit is configured to change a voltage of the driving pulse to be applied.

10. The recording apparatus according to claim 1, wherein the acquisition unit is a sensor configured to measure atmospheric pressure.

11. The recording apparatus according to claim 1, wherein the acquisition unit is configured to acquire information about an installation location of the recording apparatus and determine the atmospheric pressure on a basis of the information about the installation location.

12. The recording apparatus according to claim 11, wherein the information about the installation location is information including any of a height above sea level, a latitude, a longitude, and a name of a region.

13. A method of determining an ink ejection state, comprising:

applying a driving pulse to a recording element of a recording head to eject ink, the recording head including a plurality of ejection ports and the recording element provided at a position corresponding to each of the ejection ports and configured to generate heat energy, the recording head being configured to eject ink from each of the ejection ports by driving of the recording element;

acquiring information about atmospheric pressure around the recording head;

setting the driving pulse applied to the recording element at time of determining the ink ejection state on a basis of the acquired information about the atmospheric pressure;

detecting a temperature change in a vicinity of the recording element when the recording element is driven by application of the set driving pulse; and determining the ink ejection state of each of the ejection ports on a basis of the detected temperature change.

* * * * *